US006448708B1

(12) United States Patent
Chakravorty et al.

(10) Patent No.: US 6,448,708 B1
(45) Date of Patent: Sep. 10, 2002

(54) DUAL-LAYER METAL FOR FLAT PANEL DISPLAY

(75) Inventors: Kishore K. Chakravorty, San Jose, CA (US); Swayambu Ramani, San Jose, CA (US); Stephanie J. Oberg, Sunnyvale, CA (US); Johan Knall, Sunnyvale, CA (US); Duane A. Haven, Umpqua, OR (US); Ronald S. Besser, Ruston, LA (US); Paul J. Louris, Mountain View, CA (US); Arthur J. Learn, Cupertino, CA (US); Christopher J. Spindt, Menlo Park, CA (US); Roger W. Barton, Tofte, MN (US)

(73) Assignee: Candescent Intellectual Property Services, Inc., San Jose, CA (US)

( * ) Notice: Subject to any disclaimer, the term of this patent is extended or adjusted under 35 U.S.C. 154(b) by 75 days.

(21) Appl. No.: 09/588,118

(22) Filed: May 31, 2000

Related U.S. Application Data

(63) Continuation-in-part of application No. 09/437,346, filed on Nov. 9, 1999, which is a continuation of application No. 08/932,318, filed on Sep. 17, 1997, now Pat. No. 5,894,188.

(51) Int. Cl.[7] ..... H01J 1/02

(52) U.S. Cl. ..... 313/495; 313/309; 313/336; 313/351; 313/310

(58) Field of Search ..... 313/495, 309, 313/310, 336, 351

(56) References Cited

U.S. PATENT DOCUMENTS 5,066,883 A * 11/1991 Yoshioka et al. ..... 313/309
5,319,279 A * 6/1994 Watanabe et al. ..... 313/309
5,587,623 A * 12/1996 Jones ..... 313/497

FOREIGN PATENT DOCUMENTS

EP 855451 A1 7/1998 ..... C23C/14/14

* cited by examiner

*Primary Examiner*—Michael H. Day
*Assistant Examiner*—Joseph Williams
(74) *Attorney, Agent, or Firm*—Wagner Murabito & Hao LLP

(57) ABSTRACT

A flat panel display and a method for forming a flat panel display. In one embodiment, the flat panel display includes a cathodic structure which is formed within an active area on a backplate. The cathodic structure includes a emitter electrode metal composed of strips of aluminum overlain by a layer of cladding material. The use of aluminum and cladding material to form emitter electrode metal gives emitter electrode metal segments which are highly conductive due to the high conductivity of aluminum. By using a suitable cladding material and processing steps, a bond between the aluminum and the cladding material is formed which has good electrical conductivity. In one embodiment, tantalum is used as a cladding material. Tantalum forms a bond with the overlying resistive layer which has good electrical conductivity. Thus, the resulting structure has very high electrical conductivity through the aluminum layer and high conductivity into the resistive layer. Electrode structures that use resistor material, chromium-containing material, nickel and vanadium alloy, and gold are also disclosed.

10 Claims, 30 Drawing Sheets

DUAL-LAYER METAL FOR FLAT PANEL DISPLAY

This application is a continuation in part of 09/437346, filed Nov. 9, 1999, which is a continuation of 08/932318, filed Sep. 17, 1997, now U.S. Pat. No. 5,894,188;

CROSS-REFERENCE TO RELATED APPLICATION

This Application is a Continuation-in-Part of copending U.S. patent application Ser. No. 09/437,346, Entitled "DUAL-LAYER METAL FOR FLAT PANEL DISPLAY" to Chakravorty et al. filed Nov. 9, 1999. This Application is also related to United States Patent Application entitled "MULTILAYER ELECTRODE STRUCTURE AND METHOD FOR FORMING MULTILAYER ELECTRODE STRUCTURE FOR A FLAT PANEL DISPLAY DEVICE", which is filed concurrent with the filing of the present Application.

TECHNICAL FIELD

The present claimed invention relates to the field of flat panel displays. More specifically, the present claimed invention relates to a flat panel display and methods for forming a flat panel display having emitter electrode metal which provides good conductivity and which resists damage in subsequent process steps.

BACKGROUND ART

A Cathode Ray Tube (CRT) display generally provides the best brightness, highest contrast, best color quality and largest viewing angle of prior art computer displays. CRT displays typically use a layer of phosphor which is deposited on a thin glass faceplate. These CRTs generate a picture by using one to three electron beams which generate high energy electrons that are scanned across the phosphor in a raster pattern. The phosphor converts the electron energy into visible light so as to form the desired picture. However, prior art CRT displays are large and bulky due to the large vacuum envelopes that enclose the cathode and extend from the cathode to the faceplate of the display. Therefore, typically, other types of display technologies such as active matrix liquid crystal display, plasma display and electroluminescent display technologies have been used in the past to form flat panel displays.

Recently, a thin flat panel display commonly referred to as a field emission display (FED) has been developed which uses the same process for generating pictures as is used in CRT devices. These FEDs use a backplate including a matrix structure of rows and columns of electrodes. One such FED flat panel display is described in U.S. Pat. No. 5,541,473 which is incorporated herein by reference. Typically, the backplate is formed by depositing a cathode structure (electron emitting) on a glass plate. The cathode structure includes emitters that generate electrons. The backplate typically has an active area surface within which the cathode structure is deposited. Typically, the active area surface does not cover the entire surface of the glass plate and a thin strip is left around the edges of the glass plate. The thin strip is referred to as a border or a border region. Conductive traces extend through the border to allow for electrical connectivity to the active area surface.

Prior art flat panel displays include a thin glass faceplate (anode) having a layer of phosphor deposited over the surface of the faceplate. A conductive layer is deposited on the glass or on the phosphor. The faceplate is typically separated from the backplate by about 1 millimeter. The faceplate includes an active area surface within which the layer of phosphor is deposited. The faceplate also includes a border region. The border is a thin strip that extends from the active area surface to the edges of the glass plate. The faceplate is attached to the backplate using a glass sealing structure. This sealing structure is typically formed by melting a glass frit in a high temperature heating step. This forms an enclosure which is pumped out so as to produce a vacuum between the active area surface of the backplate and the active area surface of the faceplate.

Prior art cathodic structures are typically formed by depositing a first layer of metal over a glass plate (first metal layer). This first metal layer is then masked and etched so as to form emitter electrodes (rows or columns). Typically, a resistive layer formed of silicon carbide (SiC), Cermet, or a combination of SiC and Cermet is deposited over the emitter electrode metal. A dielectric layer is then deposited. A second layer of metal is then deposited over the surface of the cathodic structure. A series of mask and etch steps are then performed so as to form gate electrodes (rows or columns). The mask and etch steps also form openings in the gate electrode metal which extend through the dielectric layer so as to expose portions of the resistive layer. Emitters are formed over the exposed portions of the emitter electrode metal and within the openings in the gate metal by a series of deposition and etch steps. Individual regions of the cathode are selectively activated by applying electrical current to selected conductive strips of emitter electrode metal and selected conductive strips of gate metal so as to generate electrons which strike the phosphor so as to generate a display within the active area surface of the faceplate. These FEDs have all of the advantages of conventional CRTs but have the great advantage of being much thinner.

The first metal layer of a FED is typically formed of an alloy of nickel (approx. 92%) and vanadium (approx. 8%). A nickel vanadium alloy is used since it gives a good electrical bond with the overlying resistive layer and because it is resistant to damage and contamination in subsequent process steps. However, the resistivity of the nickel vanadium layer is approximately 55 micro-ohms-centimeter. This high resistivity causes signal delay. Signal delay causes decreased performance and inconsistent display quality. In addition, nickel vanadium alloy is expensive.

In an attempt to overcome the problems associated with the use of nickel vanadium alloy in emitter electrode metal formation, manufacturers have attempted to use less resistive materials such as aluminum. However, many of these less resistive materials unfortunately do not meet process compatibility requirements. In addition, many of these less resistive materials typically do not form a sufficient electrical contact with the overlying resistive layer to function effectively. This is primarily due to the native oxide that forms on the surface of the conductive layer inhibiting current flow. In addition, subsequent process steps damage and contaminate the surface of the aluminum. In particular, the alkaline and acidic solutions used in subsequent process steps attack aluminum. Moreover, subsequent rinsing and cleaning steps may leave deposits that adhere to the surface of the aluminum. These contaminants further degrade the quality of electrical contact between the emitter electrode metal and the resistor.

One of the reasons that aluminum forms a poor electrical bond with the overlying resistive layer is oxidation of the surface of the aluminum. This oxidation results from exposure to atmospheric conditions. Prior art methods have attempted to get a good electrical bond between the Aluminum and the overlying resistive layer by performing an etch on the aluminum layer such as a sputter etch. This sputter etch removes accumulated oxidation (aluminum oxide). Though sputter etching gives good results for small surface areas, sputter etching does not give consistent coverage across the large surface areas required for current FEDs. For the above reasons, aluminum has significant disadvantages when used in forming emitter electrode metal in prior art FED devices.

Accordingly, what is needed is a FED with emitter electrode metal which minimizes signal delay and which meets signal propagation and other performance criteria and process compatibility criteria. In addition, a FED is needed that has emitter electrode metal which is easy to deposit and etch and which can be formed using current processing techniques. Moreover, processing methods for forming a FED with emitter electrode metal that has low resistivity and that forms a good bond with a resistive layer are required. Furthermore, processing methods are needed for forming a FED with emitter electrode metal that is resistant to damage during subsequent processing steps. The present invention meets the above needs.

DISCLOSURE OF THE INVENTION

The present invention provides a field emission display (FED) which includes an improved cathodic structure. The cathodic structure includes emitter electrode metal which is highly conductive. The emitter electrode metal is formed using aluminum which is overlain by a thin cladding layer.

In one embodiment of the present invention, a faceplate is formed by depositing luminescent material within an active area surface formed on a glass plate. A cathodic structure is formed within an active area on a backplate. Walls are attached to either the faceplate or the backplate. A glass sealing material is placed within the border of the faceplate. The backplate is then placed over the faceplate such that the walls and the glass frit are disposed between the faceplate and the backplate. The assembly is then sealed by thermal processing and evacuation steps so as to form a complete FED.

The cathodic structure includes rows of metal strips aligned roughly parallel to each other (herein referred to as "emitter electrodes"). Each strip includes a layer of aluminum overlain by a layer of cladding material. A resistive layer overlies the emitter electrode metal. A dielectric layer overlies the resistive layer. Gate metal overlies the dielectric layer. Gate metal are rows of strips of conductive material which are aligned roughly parallel to each other. Openings which extend through the gate metal and through the dielectric layer expose portions of the resistive layer. Emitters are formed within the openings in the gate metal and the dielectric layer such that they are electrically coupled to the resistive layer. In operation, electrical current is applied to one or more strips of the emitter electrode metal and to one or more strips of gate metal such that emitters disposed over the strips of emitter electrode metal to which current is applied and within openings in the strips of gate metal to which current is applied are engaged such that they emit electrons. These electrons strike the phosphor deposited on the faceplate so as to produce a visible display.

The use of aluminum and cladding material to form emitter electrode metal gives emitter electrode metal segments which are highly conductive due to the high conductivity of aluminum. By using processing steps and a cladding material which will not interdiffuse in subsequent thermal process steps, emitter electrode metal is formed which maintains good electrical conductivity with overlying structures even after high temperature process steps. A cladding material which forms a good bond with the overlying resistive layer is used. In one embodiment, a refractory metal such as tantalum is used as a cladding material. When using silicon carbide to form the resistive layer a bond which has good electrical conductivity is formed between the tantalum layer and the silicon carbide. Thus, the resulting structure has very high electrical conductivity (through the aluminum layer) and high conductivity into the resistive layer.

In one embodiment, aluminum is deposited, masked and etched to form aluminum strips. A cladding layer of tantalum is then deposited over the aluminum strips. An etch is then performed so as to remove some or all of the tantalum between adjacent strips of aluminum and tantalum.

In an alternate embodiment, the aluminum and the cladding layer are deposited sequentially in a vacuum deposition chamber. The resulting structure is then masked and etched to form strips having aluminum overlain by the cladding layer. The sequential deposition process gives a more uniform cladding layer since oxidation between the aluminum layer and the cladding layer is avoided and since contamination that may occur from masking, etching, and photoresist removal steps is avoided.

The present invention produces a structure which has favorable conductivity characteristics and which has conductivity characteristics which are consistent throughout the emitter electrode metal. In addition, as a result of the cladding layer's resistance to damage, the emitter electrode metal is not damaged in process steps subsequent to the step of depositing the cladding layer.

The favorable conductivity characteristics are consistent throughout the emitter electrode metal as a result of the cladding layer's resistance to damage in subsequent process steps. In particular, tantalum and other refractory metals resists damage when exposed to etchant chemicals and processing chemicals such as alkaline and acidic solutions which are commonly used in subsequent process steps. Aluminum is desirable as a conductor since it is commonly used in electronic circuit devices and because it is inexpensive and it has good conductivity.

In another embodiment of the present invention, two-layer electrode structures are disclosed that include chromium-containing material. One two-layer electrode structure includes a layer of chromium, and a layer of nickel and vanadium alloy. Three-layer structures are also disclosed. In yet another embodiment of the present invention, one or more resistor layer is used to prevent damage to an electrode.

These and other objects and advantages of the present invention will no doubt become obvious to those of ordinary skill in the art in light of the following detailed description of the preferred embodiments that are illustrated in the various drawing figures.

BRIEF DESCRIPTION OF THE DRAWINGS

The accompanying drawings, which are incorporated in and form a part of this specification, illustrate embodiments of the invention and, together with the description, serve to explain the principles of the invention.

BEST MODE FOR CARRYING OUT THE INVENTION

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

In one embodiment of the present invention, a faceplate which has one or more layers of phosphor deposited thereon is coupled to a backplate onto which a cathodic structure is formed. The cathodic structures includes emitters such as emitter 140 of FIG. 11 and emitter 340 of FIG. 3 which emit electrons that strike the phosphor layers on the faceplate so as to emit visible light and form a visible display.

Figure 1A:
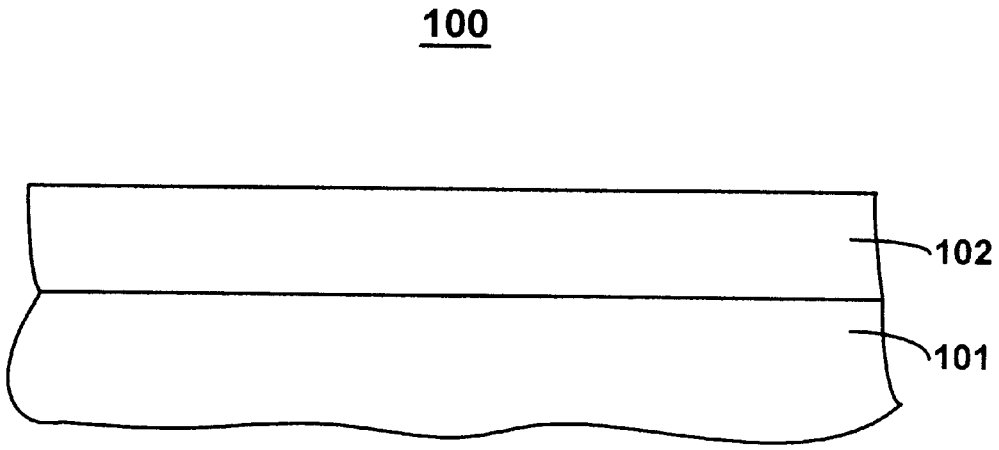
FIG. 1A is a side cross sectional view illustrating a step for depositing a layer of aluminum on a glass plate in accordance with the present claimed invention.
Figure 1B:
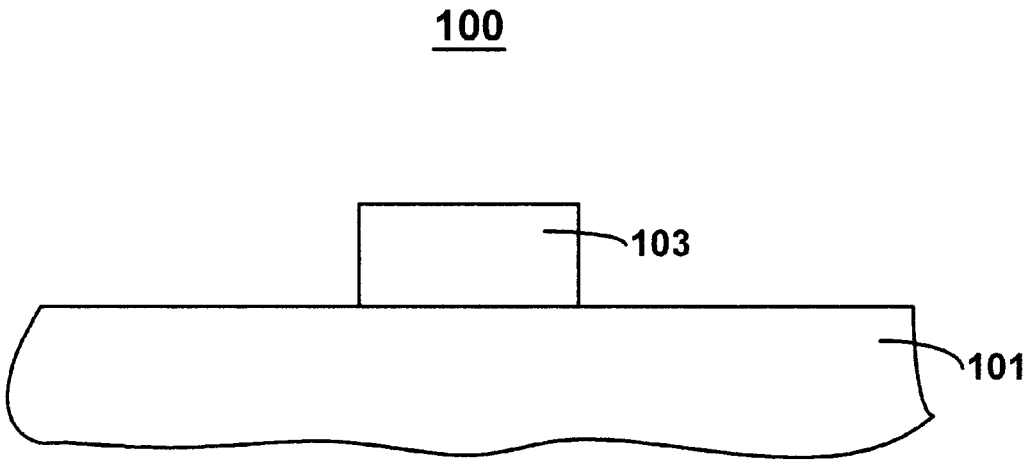
FIG. 1B is a side cross sectional view illustrating etching of an aluminum strip in accordance with the present claimed invention.
Figure 1C:
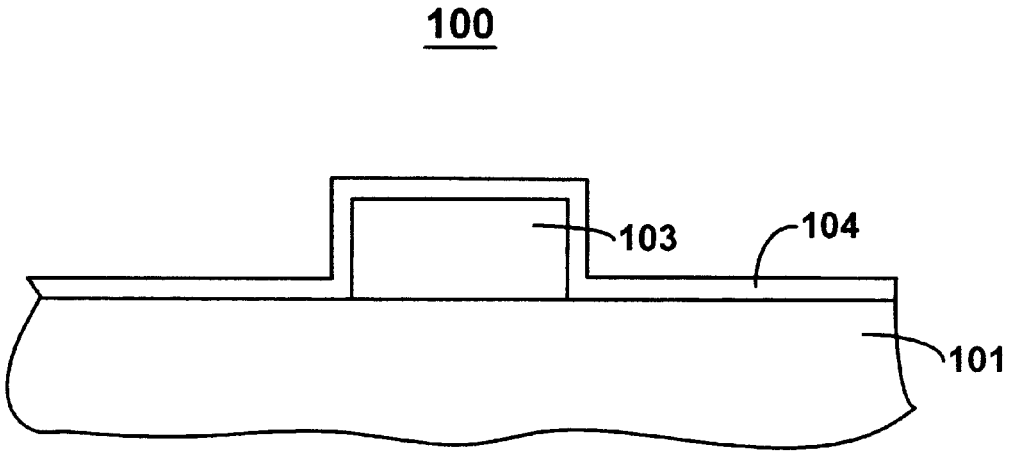
FIG. 1C is a side cross sectional view illustrating the deposition of a cladding layer in accordance with the present claimed invention.
Figure 1D:
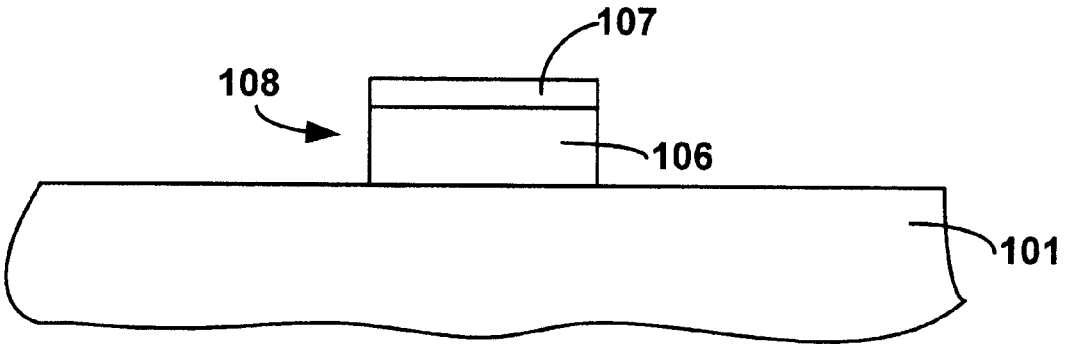
FIG. 1D is a side cross sectional view illustrating the structure of FIG. 1C after a mask and etch step in accordance with the present claimed invention.
Figure 1E:
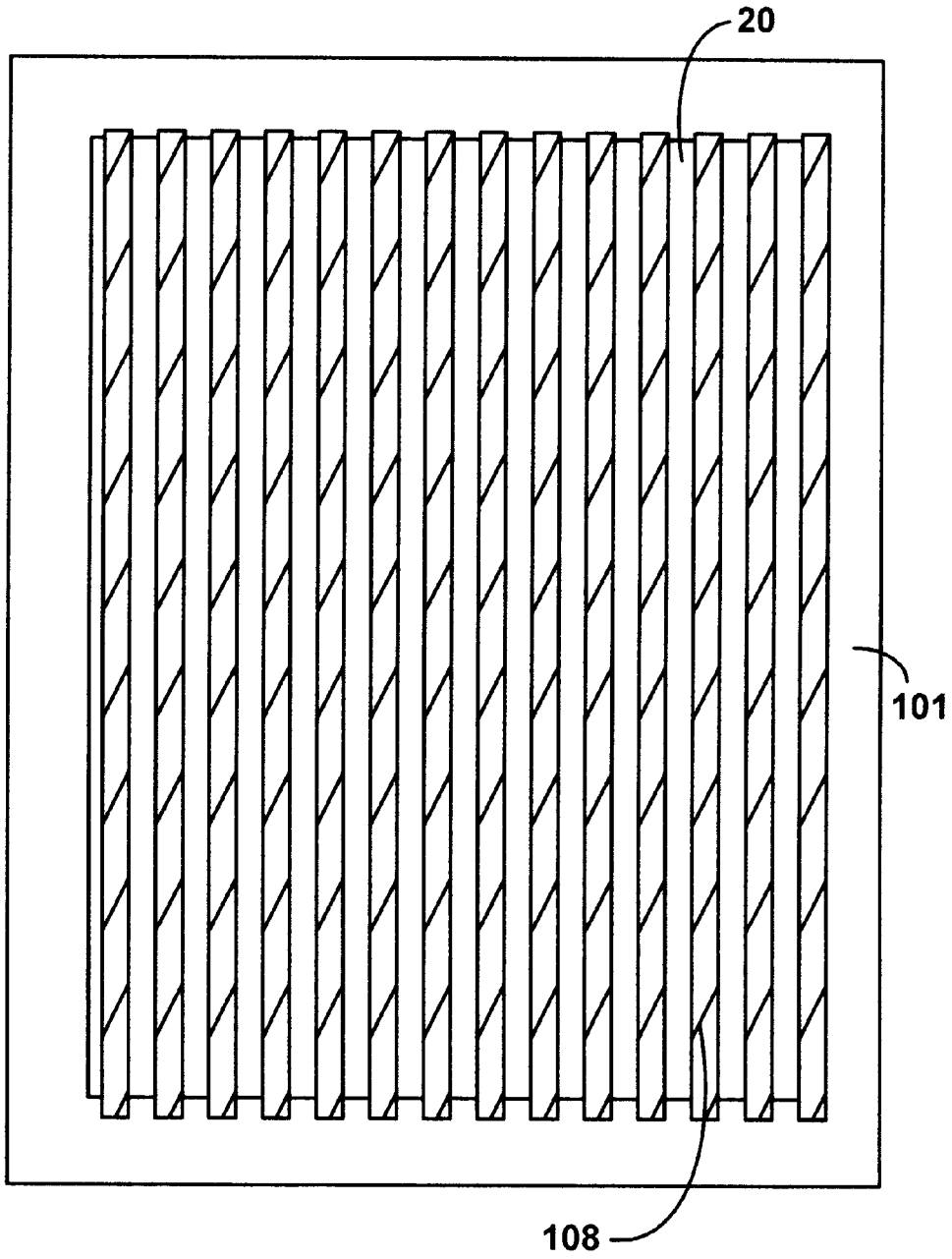
FIG. 1E is a top view illustrating emitter electrode metal strips in accordance with the present claimed invention.
Figure 1F:
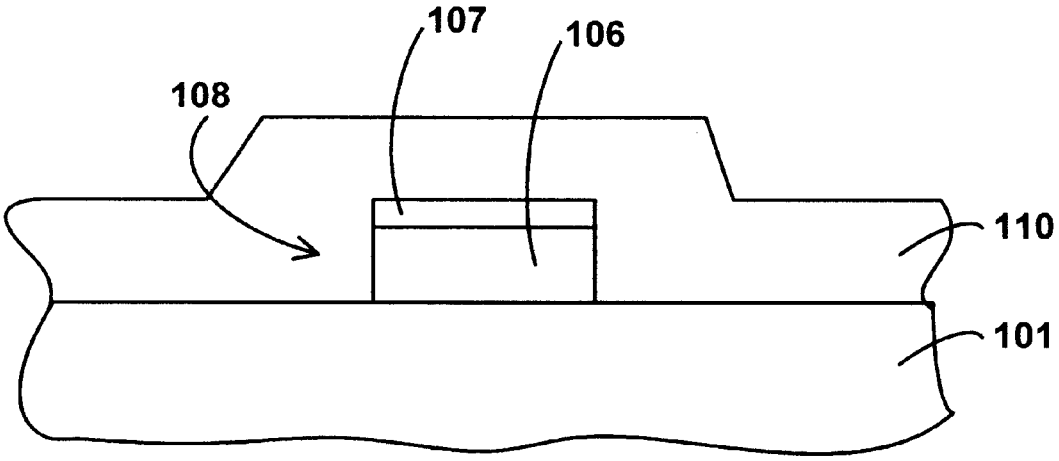
FIG. 1F is a side cross sectional view illustrating the deposition of a resistive layer in accordance with the present claimed invention.
Figure 1G:
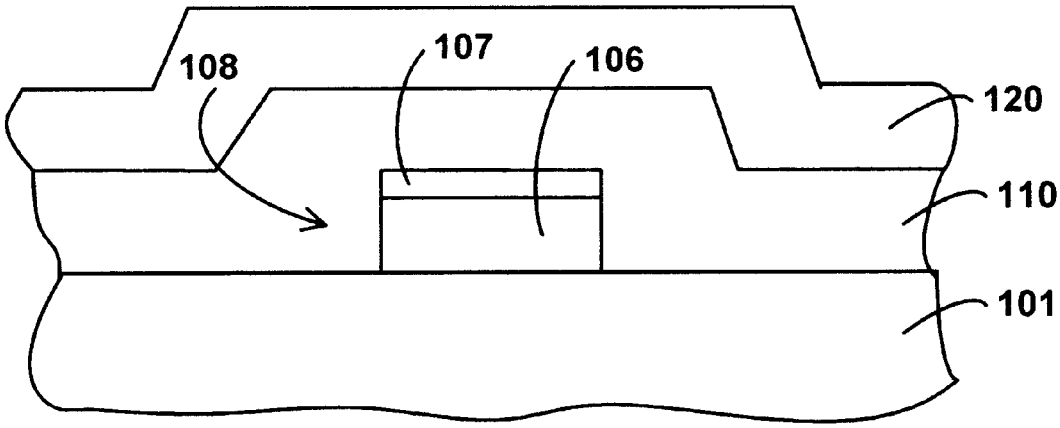
FIG. 1G is a side cross sectional view illustrating the deposition of a dielectric layer in accordance with the present claimed invention.
Figure 1H:
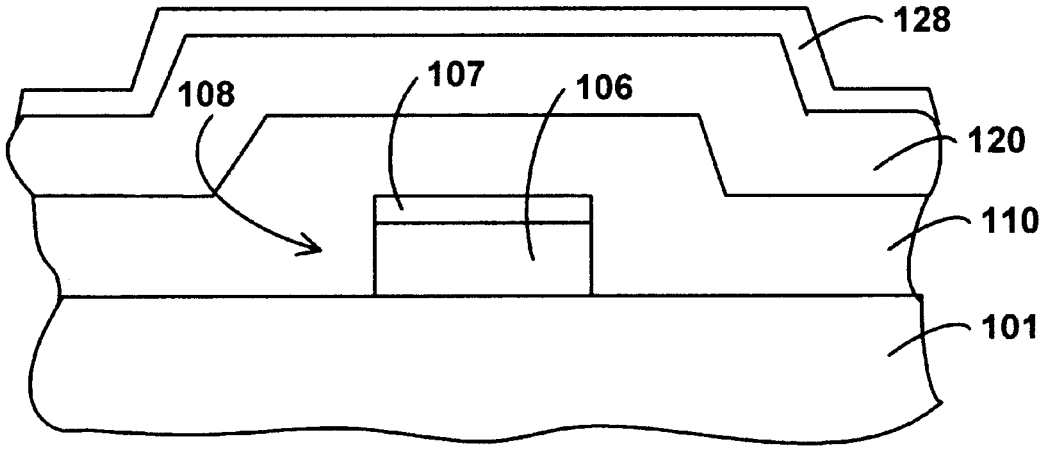
FIG. 1H is a side cross sectional view illustrating the deposition of a metal layer in accordance with the present claimed invention.
Figure 1I:
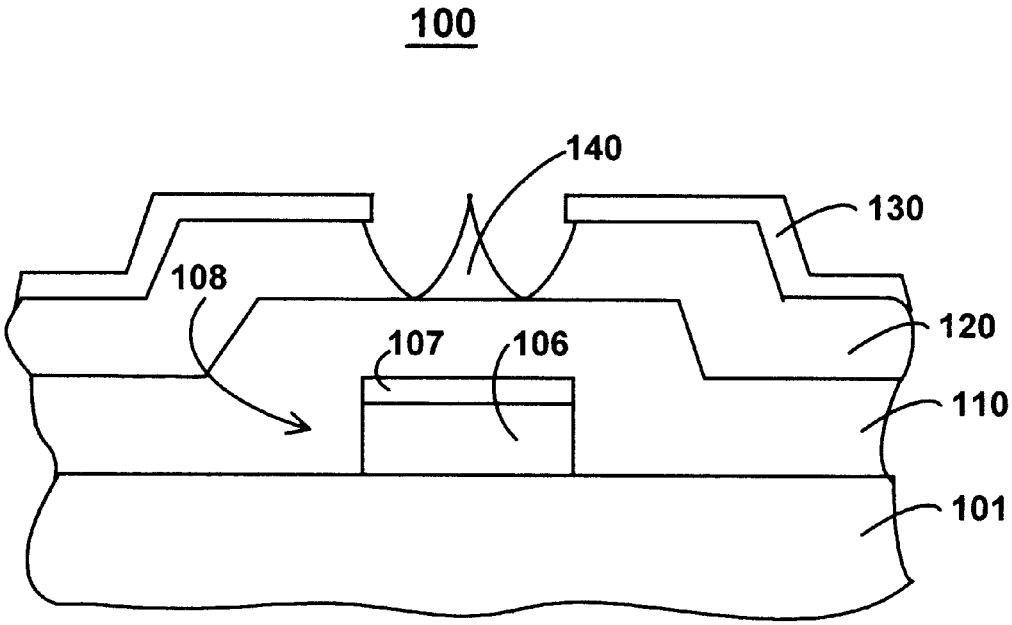
FIG. 1I is a side cross sectional view of the structure of FIG. 1H after mask and etch steps and emitter formation steps in accordance with the present claimed invention.

Backplate 100 of FIGS. 1A–1J includes a cathodic structure which includes emitter electrode metal formed of a layer of aluminum over which a layer of cladding material is deposited. FIG. 2 shows a process 201 for forming a FED. With reference to step 210 of FIG. 2, backplate 100 is formed by first depositing an aluminum layer over the backplate 100. FIG. 1A shows backplate 100 which includes glass plate 101 over which aluminum layer 102 is deposited. In one embodiment, aluminum layer 102 is deposited by a sputter deposition process.

The aluminum layer is then masked and etched as shown by step 211 of FIG. 2. FIG. 1B shows the structure of FIG. 1A after mask and etch steps have etched aluminum layer 102 of FIG. 1A so as to form aluminum strip 103. If required, a cleaning step such as an ion cleaning step or a sputter etch may be used to clean the surface of the aluminum. In one embodiment, a sputter etch using an argon plasma is used to clean the surface of the aluminum.

A layer of cladding material is then deposited over backplate 100 as shown by step 212 of FIG. 2. FIG. 1C shows the structure of FIG. 1B after the deposition of cladding layer 104. In one embodiment, cladding layer 104 is deposited by a sputter deposition process. If required, a cleaning step such as an ion cleaning step or a sputter etch may be used to clean the surface of the aluminum prior to the step of depositing the cladding layer. In one embodiment, a sputter etch using an argon plasma is used to clean the surface of the aluminum. In one embodiment, cladding layer 104 is formed of a refractory metal. In one embodiment tantalum is used since it makes good electrical contact with overlying resistive layers and since it does not interdiffuse with aluminum. In addition, tantalum is compatible with all of the subsequent process steps and process chemicals which are typically used. In particular tantalum is resistant to process chemicals and is easy to process.

Mask and etch steps are then performed as shown by step 213 of FIG. 2. These mask and etch steps form emitter electrode metal strips such as emitter electrode metal strip 108 which extends across active area 20 as shown in FIG. 1E. With reference to FIG. 1D, the mask and etch steps remove the cladding material which overlies glass plate 101 and the cladding material which is deposited over the side surfaces of aluminum strip 106. This leaves cladding layer 107 which overlies aluminum strip 106 so as to form emitter electrode metal strip 108. A wet etch could be used to etch both the cladding layer and the aluminum.

In one embodiment a reactive ion etch process is used to etch the aluminum and the cladding layer. In this embodiment, a first etch using fluorine plasma is used to etch through the cladding layer. This etch stops on aluminum. The etch of the aluminum is then performed using a chlorine plasma. The etch is followed with a fluorine gas rinse to remove residual chlorine. In one embodiment, an etch process is used to yield a structure which has side surfaces that are sloped, rather than running vertically. FIG. 1K shows emitter electrode metal strip 198 formed by etching aluminum layer 196 and cladding layer 197 using an etch process such that side surface 191 and side surface 192 are sloped. This structure allows for good step coverage of subsequent overlying layers. In addition, this structure is favorable for stress purposes, resulting in less damage to the cathodic structure upon subsequent thermal processing steps.

A resistive layer is then deposited as shown by step 214 of FIG. 2. In one embodiment, silicon carbide (SiC) is used as a resistor. FIG. 1F shows the structure of FIG. 1D after resistive layer 110 is deposited. Resistive layer 110 overlies emitter electrode metal strip 108. In particular, resistive layer 110 overlies cladding layer 107 and surrounds the sides of aluminum layer 106. In one embodiment, resistive layer 110 is formed by depositing a first layer of silicon carbide having a thickness of approximately 2000 angstroms which is nitrogen doped to tailor it's resistivity to the requirements of the system. A thin layer of Cermet is then deposited over the SiC layer to complete the resistive layer. In one embodiment, the layer of Cermet has a thickness of approximately 500 angstroms. Cermet is a resistive material sold commercially by Pure Tech Incorporated of Carmel, N.Y. which is formed from silicon dioxide (SiO2) and chromium (Cr).

The formation of the cathodic structure is then completed as shown in steps 218, 220, 222. and 224 of FIG. 2. In the present embodiment, a dielectric layer is deposited over the resistive layer as shown by step 216 of FIG. 2. In one embodiment, a dielectric layer having a thickness of approximately 1500 angstroms is deposited. FIG. 1G shows the structure of FIG. 1F after dielectric layer 120 is deposited over resistive layer 110. In the present embodiment, silicon dioxide is used to form dielectric layer 120.

Next, gate metal is formed by depositing a layer of metal over the surface of backplate 100. In one embodiment, chromium is used to form gate metal. FIG. 1H shows the structure of FIG. 1G after a layer of metal 128 is deposited. The layer of metal is then masked and etched as shown by step 220 of FIG. 2. Next, emitter openings are etched. Emitter openings may be etched by any of a number of known etch methods. In one embodiment, damage tracks are used to locate emitter openings which are then etched. Emitters are then formed within emitter openings as shown by step 224 of FIG. 2. FIG. 11 shows the structure of FIG. 1H after mask and etch steps have etched gate metal strips, shown generally as gate metal strip 130, after etching emitter openings, and after emitters, shown generally as emitter 140 are formed in backplate 100. Gates (not shown) and other required structures and circuits are also formed to complete the backplate.

Figure 1J:
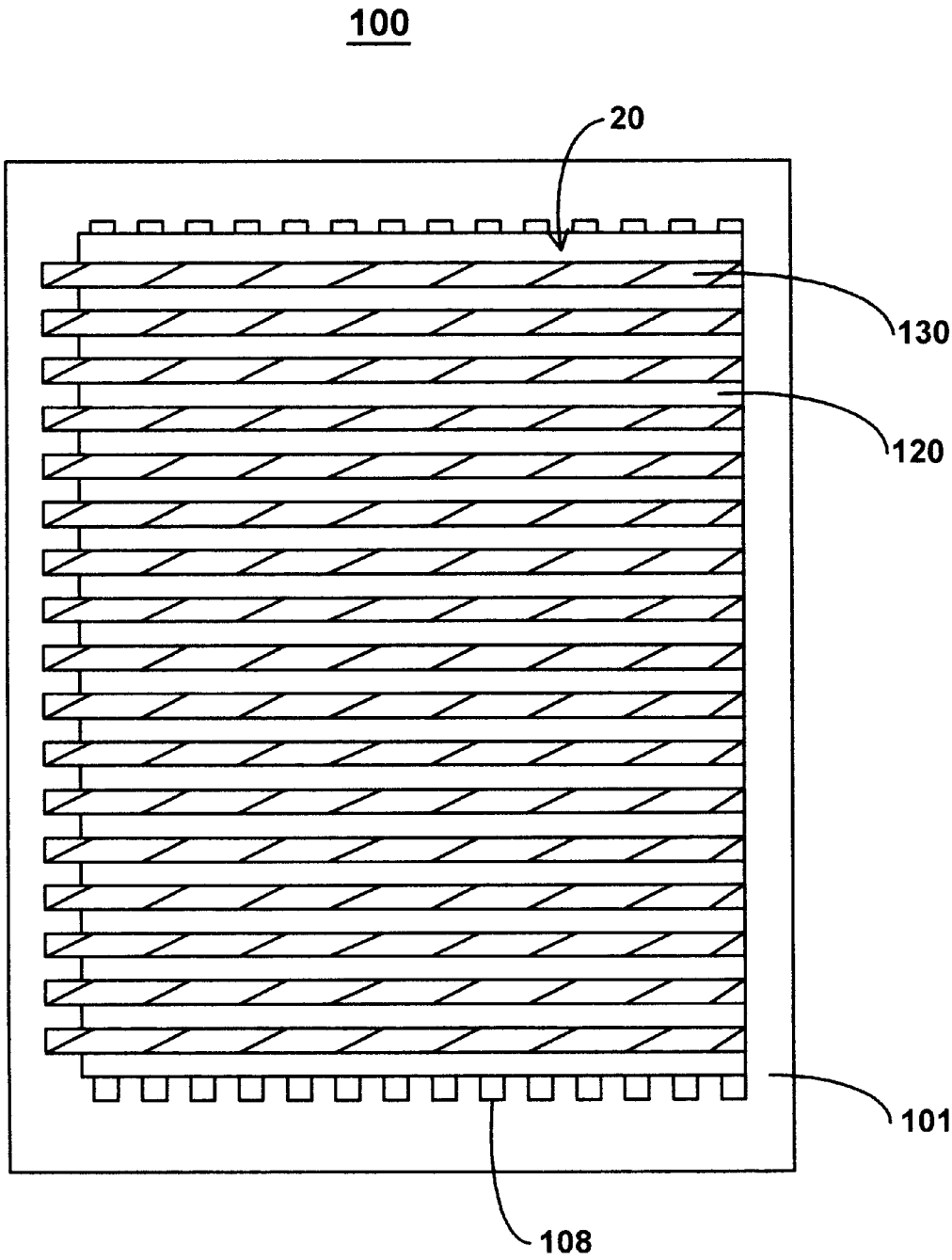
FIG. 1J is a top view illustrating a completed cathodic structure in accordance with the present claimed invention.
Figure 1K:
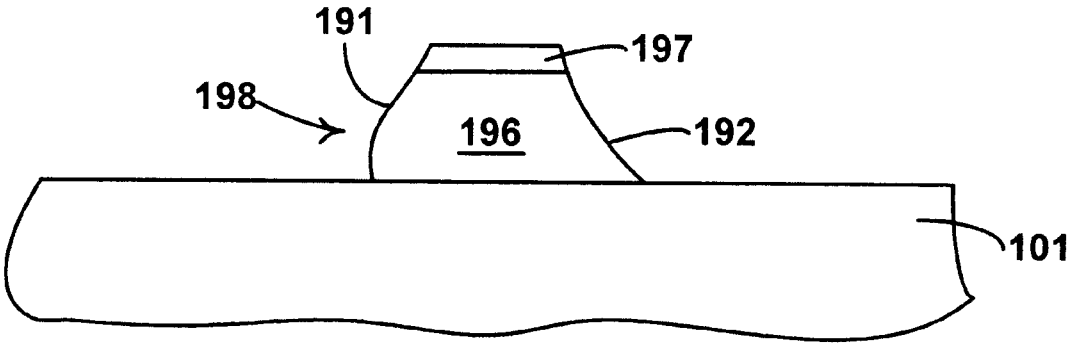
FIG. 1K is a side cross sectional view illustrating an embodiment having a favorable sidewall profile in accordance with the present claimed invention.
Figure 2:
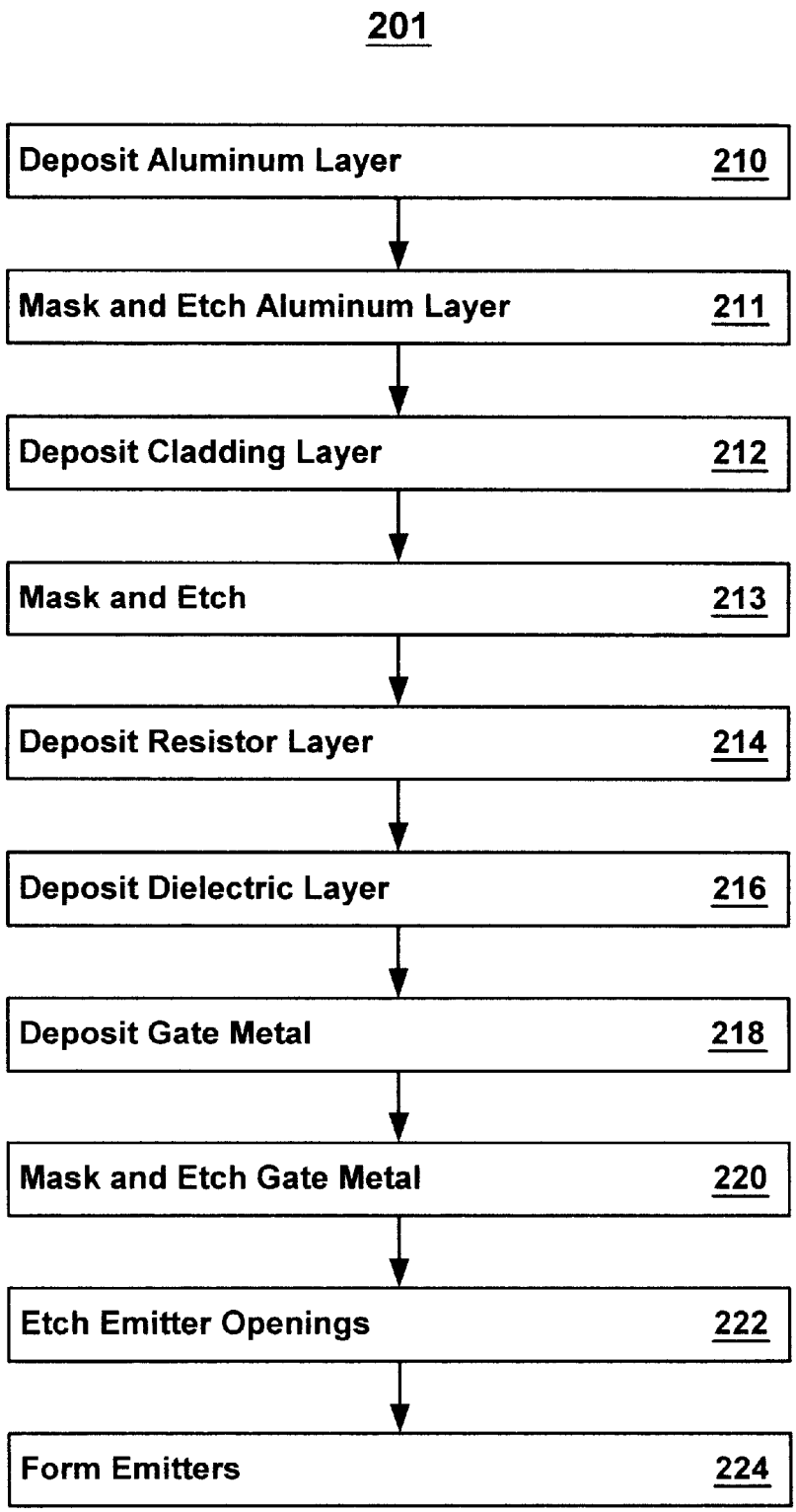
FIG. 2 is a diagram illustrating a method for forming a field emission display in accordance with the present claimed invention.

FIG. 1J shows backplate 100 after completion of steps 210-214, 216, 218, 220, 222, and 224 of FIG. 2 as shown in FIGS. 1A–1I. The completed cathodic structure formed over glass plate 101 includes gate metal strips, shown generally as gate metal strip 130. In one embodiment, gate metal strips 130 have a thickness of approximately 1500 angstroms. Gate metal strips 130 extend out of active area 20 for connection to electronic circuits. Similarly, emitter electrode metal strips 108 extend out of active area 20 for connection to electronic circuits.

In an alternate embodiment the cladding layer overlies the sides of each aluminum strip. With reference to FIG. 2, an aluminum layer is deposited, as shown by step 210 of FIG. 2, and masked and etched, as shown by step 211. The photoresist used in the etch process is then stripped. The layer of cladding material is deposited, as shown by step 212 and the cladding layer is masked and etched as shown by step 213. However, the mask and etch steps only remove some or all of that portion of the cladding layer which overlies the glass plate between each aluminum strip (so as to prevent contact between aluminum strips). Thus the sides of each aluminum strip are not exposed. The resistor layer is then deposited over the cladding layer as shown by step 214. The dielectric layer is then deposited and gate metal is masked and etched as shown by steps 216, 218 and 220. As shown by steps 222 and 224, emitter openings are etched and emitters are formed.

Figure 3:
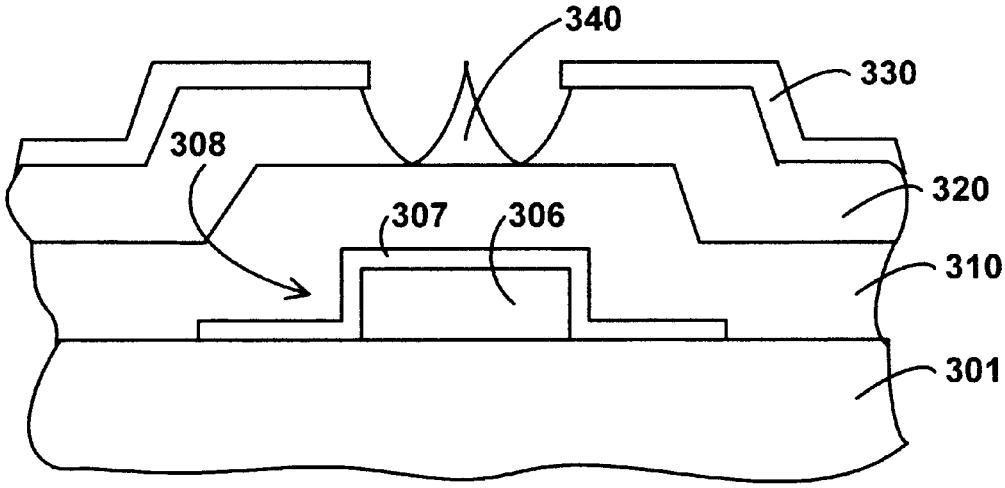
FIG. 3 is a cross sectional view illustrating a method for forming a field emission display in accordance with the present claimed invention.

FIG. 3 shows a backplate in which cladding material is left overlying the top and sides of each of aluminum strip, shown generally as aluminum strip 306. Cladding, shown generally as cladding layer 307, seals each of aluminum strips 306 so as to form emitter electrode metal strips shown generally as emitter electrode metal strip 308. Since the sides of each aluminum strip 306 are sealed with cladding, aluminum strip 306 is protected from damage in subsequent process steps.

Figure 4:
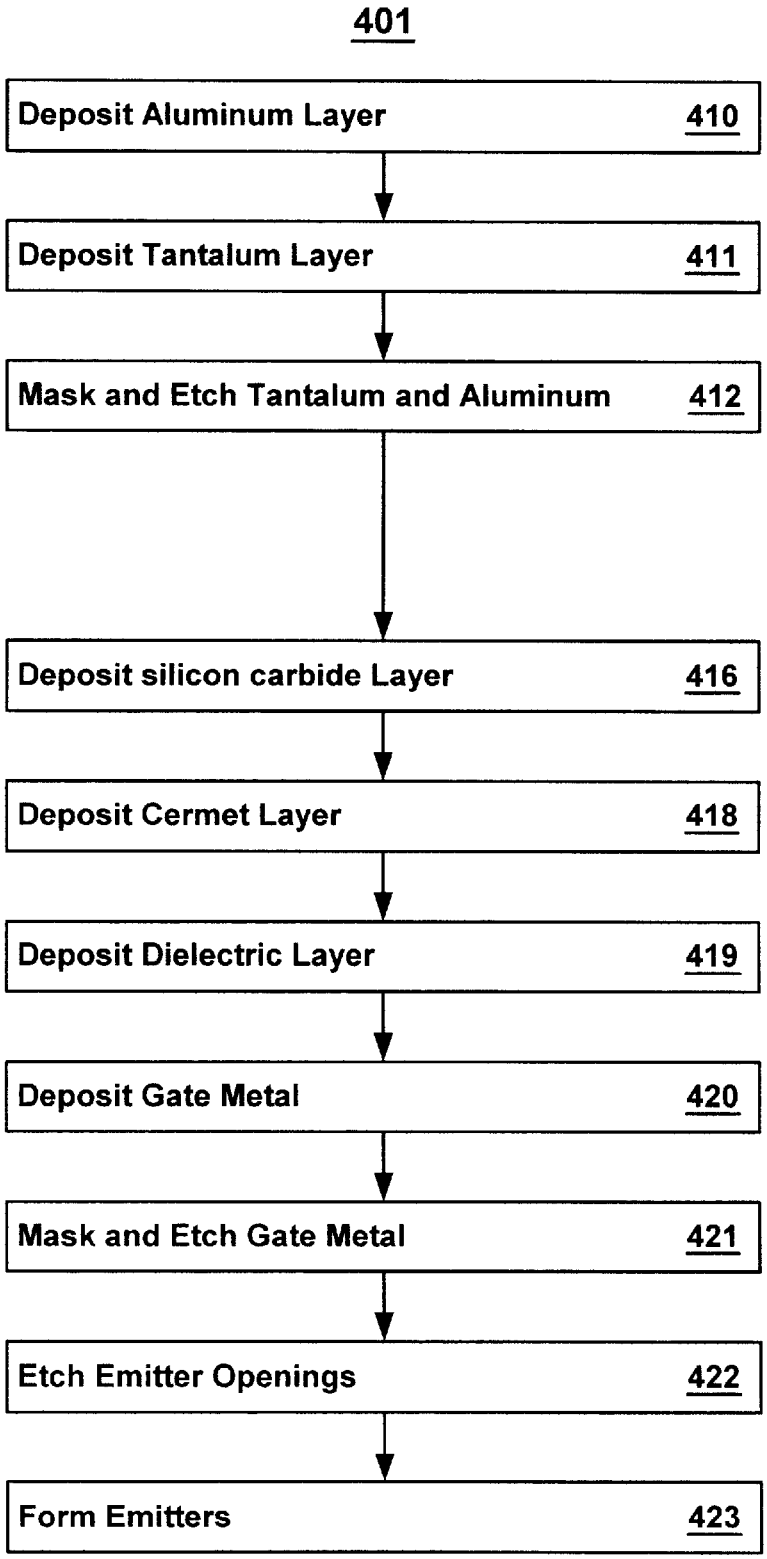
FIG. 4 is a diagram illustrating steps for forming a field emission display in accordance with the present claimed invention.

In one embodiment, deposition of aluminum and cladding material is performed sequentially. FIG. 4 shows a process for forming a FED using a sequential aluminum and cladding deposition process. As shown in FIG. 4, in this embodiment, an aluminum layer is deposited as shown by step 410 which is followed by a layer of cladding material as shown by step 411. In one embodiment this process is performed by sequentially depositing the aluminum layer and the cladding layer in a vacuum deposition chamber by sputter deposition methods. The sequential deposition of the aluminum and cladding layers prevents oxidation and contamination of the aluminum interface between the aluminum and cladding layers. The aluminum and cladding layers are then etched as shown by step 412. In one embodiment, when tantalum is used as a cladding material, a first etch using fluorine plasma is used to etch through the cladding material. This etch stops on the aluminum layer. The aluminum layer is then etched using a chlorine plasma. The etch is followed with a fluorine gas rinse to remove residual chlorine. The photoresist mask is then removed. The resistor layer is then deposited as shown by steps 416 and 418. First a layer of silicon carbide is deposited as shown by step 416. Next, a layer of Cermet is deposited as shown by step 418. The structure is then completed by depositing a dielectric layer, depositing, masking and etching gate metal, and etching emitter openings and forming emitters as shown by steps 419–423.

The use of tantalum as a cladding material prevents significant interdiffusion of the aluminum and tantalum. Even after the high temperature cycles in the fabrication process, there is little if any interdiffusion. Consequently there is no increase in the resistivity resulting from interdiffusion. This provides good horizontal and vertical electrical conductivity. The improved horizontal and vertical conductivity of the present invention reduces signal propagation delay and allows for the production of brighter displays having faster refresh rates.

Though the present invention is described with reference to the use of a refractive metal such as tantalum as a cladding material, any of a number of other materials could be used if those materials meet the criteria of easy to process, not interdiffusing with aluminum, make good electrical contact with the aluminum layer, make good electrical contact with the overlying-resistor layer, and they are compatible with subsequent process steps and processing chemicals. Other refractory metals that can be used include molybdenum, tungsten, and titanium. In addition to tantalum, other materials that can be used include niobium, nickel, chromium, metal silicides, and composite films such as tantalum nitride, titanium-tungsten, and metal silicides. In one embodiment, an aluminum and neodymium alloy is used to form emitter electrode metal and a molybdenum and tungsten alloy is used to form the protective cladding layer.

Figure 5A:
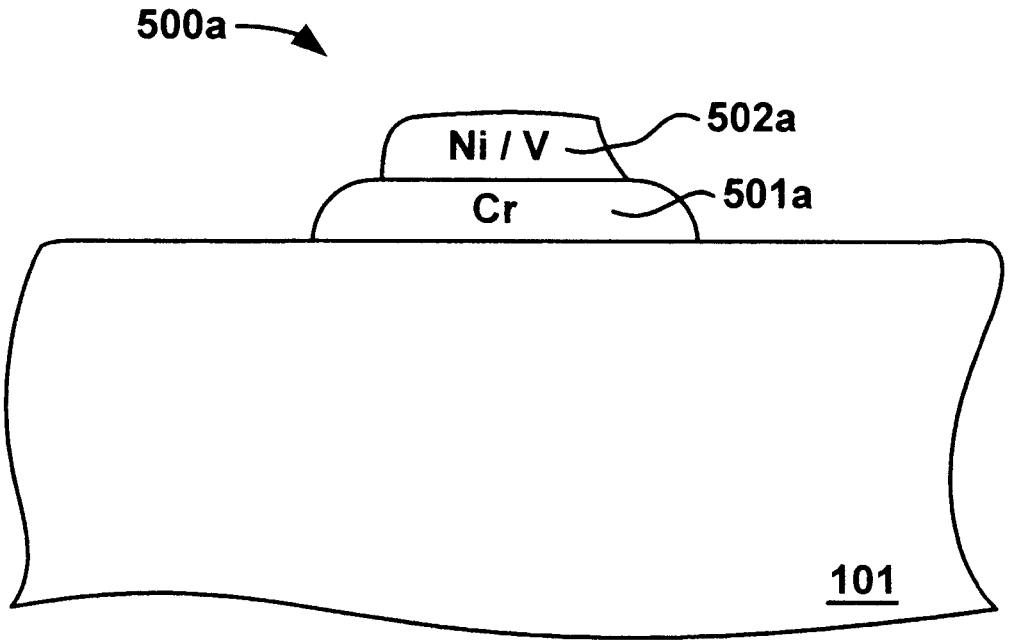
FIG. 5A is a diagram illustrating an electrode structure for a field emission display in accordance with the present claimed invention.
Figure 5B:
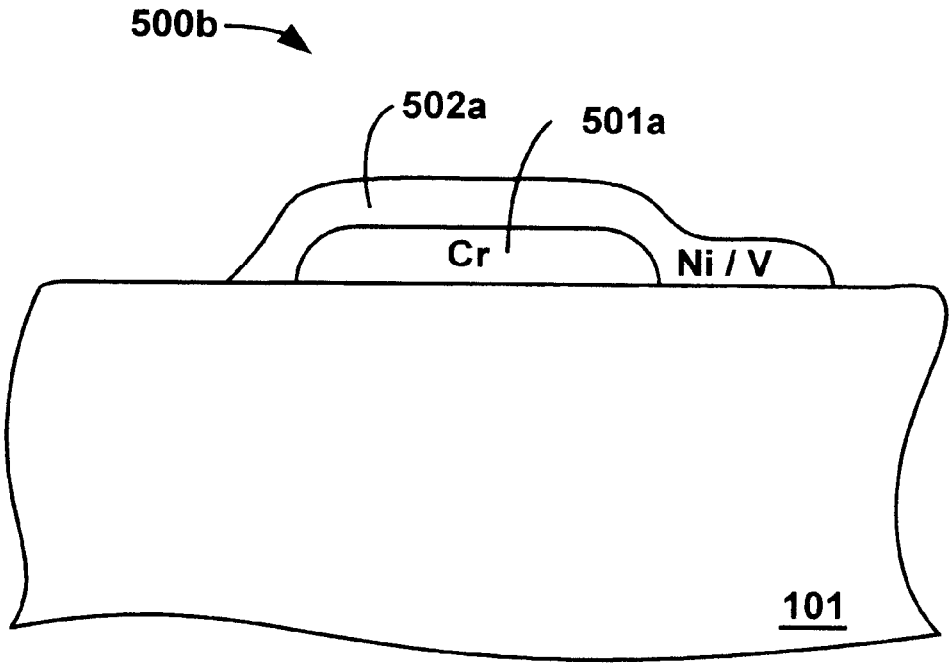
FIG. 5B is a diagram illustrating an electrode structure for a field emission display in accordance with the present claimed invention.

In one embodiment, that is illustrated in FIGS. 5A–5B, electrode structures 500*a*–500*b* include emitter electrodes that are formed by the deposition of a chromium layer. In one embodiment, the chromium layer is deposited by sputtering. Alternatively, evaporative methods, electroplating, or electroless plating methods are used to form the chromium layer. The chromium layer is masked and etched to form chromium strip 501*a*.

Continuing with FIG. 5A, a layer of nickel and vanadium alloy is then deposited. In one embodiment, the nickel and vanadium alloy layer is deposited by sputtering. Alternatively, evaporative methods, electroplating, or electroless plating methods are used to form a layer of nickel/vanadium alloy. The nickel and vanadium alloy is then masked and etched to form nickel/vanadium alloy strip 502*a* of FIG. 5A. It can be seen that nickel/vanadium alloy strip 502*a* directly overlies chromium strip 501*a*. In an alternate embodiment shown in FIG. 5B, nickel/vanadium alloy strip 502*a*' extends so that it completely covers the top and side surfaces of chromium strip 501*a*.

Figure 6A:
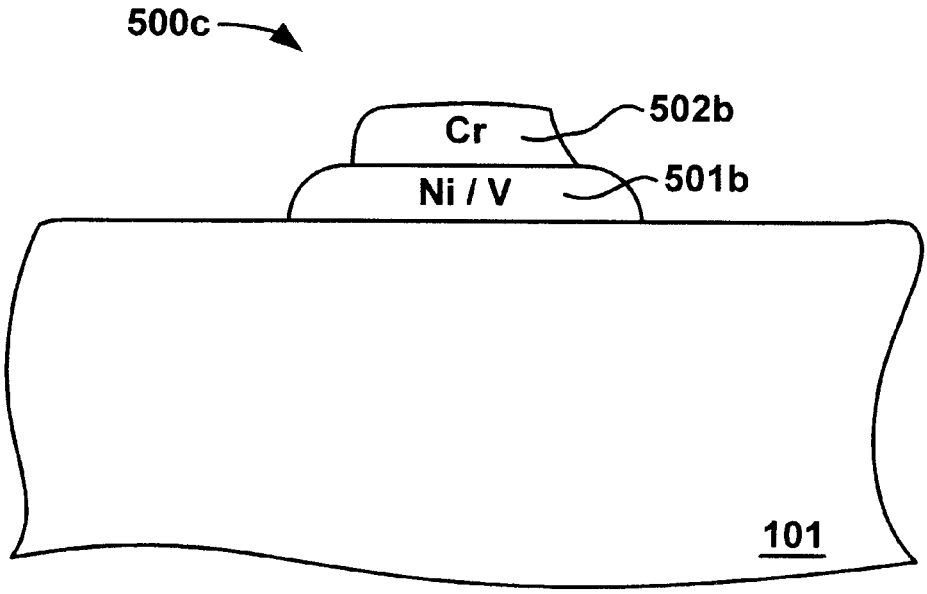
FIG. 6A is a diagram illustrating steps for forming a field emission display in accordance with the present claimed invention.
Figure 6B:
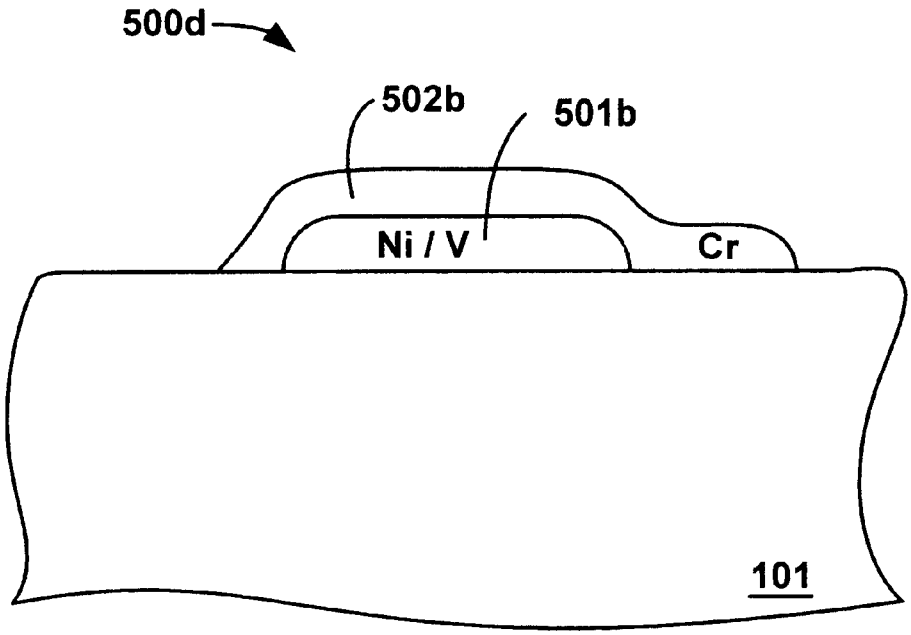
FIG. 6B is a diagram illustrating an electrode structure for a field emission display in accordance with the present claimed invention.

In the embodiment shown in FIGS. 6A–6B, electrode structures 500*c*–500*d* are formed by the deposition of a nickel and vanadium alloy layer. In one embodiment, the nickel and vanadium alloy layer is deposited by sputtering. Alternatively, evaporative methods, electroplating, or electroless plating methods are used to form the nickel and vanadium alloy layer. The nickel and vanadium layer is masked and etched to form alloy strip 501*b*.

Continuing with FIGS. 6A–6B, a layer of chromium is deposited. In the present embodiment, the chromium is deposited using a sputtering deposition process. Alternatively, evaporative methods, electroplating, or electroless plating methods are used to form the chromium layer. The layer of chromium is then masked and etched to form chromium strip 502*b* of FIG. 5A. It can be seen that chromium strip 502*b* directly overlies nickel and vanadium alloy strip 501*b*. In an alternate embodiment shown in FIG. 5B, chromium strip 502*b*' extends so that it completely covers the top and side surfaces of nickel/vanadium alloy strip 501*b*.

In one embodiment of the present invention, some or all of structures 502*a*–502*b*' of FIGS. 5A–6B are formed using self-patterned metallization techniques; thereby eliminating the need for additional mask and etch steps in the formation of strips 502*a*–502*b*'.

Referring now to the embodiments shown in FIGS. 5A–6B, the use of both a chromium strip and a nickel and vanadium alloy strip produces electrodes 500*a*–500*d* that have reduced contact resistance. Also, the resistivity of electrodes 500*a*–500*d* does not substantially increase during thermal processing in an oxidizing environment as occurs with prior art electrodes. That is, the mixture of metal where the chromium strip meets the nickel vanadium alloy strip gives a partial alloy that shares the desirable properties of each metal. Because chromium forms a mechanically tough and chemically resistant, electrically insulating oxide, and because nickel and vanadium form a mechanically softer and chemically less resistant, yet more conductive oxide, the combination produces an alloy that is chemically resistant to further oxidation, and that has a low contact resistance.

In one embodiment of the present invention that is illustrated in FIGS. 7A–8B, a three-layer structure is used to form an electrode. In the present embodiment, electrode structures 700*a*–700*d* of FIGS. 7A–8B are formed by depositing a layer of gold (Au) over electrode structures 500*a*–500*d* of FIGS. 5A–6B. In one embodiment, the layer of gold is deposited by sputtering. Alternatively, evaporative methods, electroplating, or electroless plating methods are used to form the gold layer. The layer of gold is then masked and etched to form gold strip 503*a* of FIGS. 7A–8B. In one embodiment of the present invention, structures 503*a* are formed using self-patterned metallization techniques; thereby eliminating the need for additional mask and etch steps in the formation of strips 503*a*.

Figure 7A:
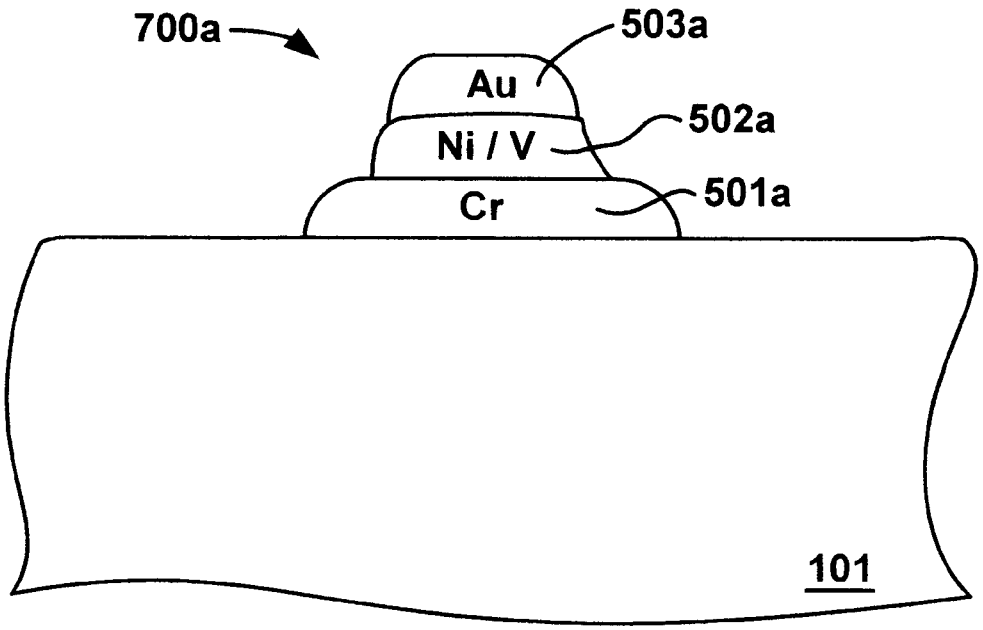
FIG. 7A is a diagram illustrating a three-layer electrode structure for a field emission display in accordance with the present claimed invention.

Referring now to the embodiment shown in FIG. 7A, a layer of gold is deposited over the structure shown in FIG. 5A, and is masked and etched to form electrode structure 700*a*. More particularly, in the present embodiment, a layer of gold is deposited, masked and etched to form gold strip 503*a*. It can be seen that gold strip 503*a* directly overlies nickel and vanadium alloy strip 502*a*.

Figure 7B:
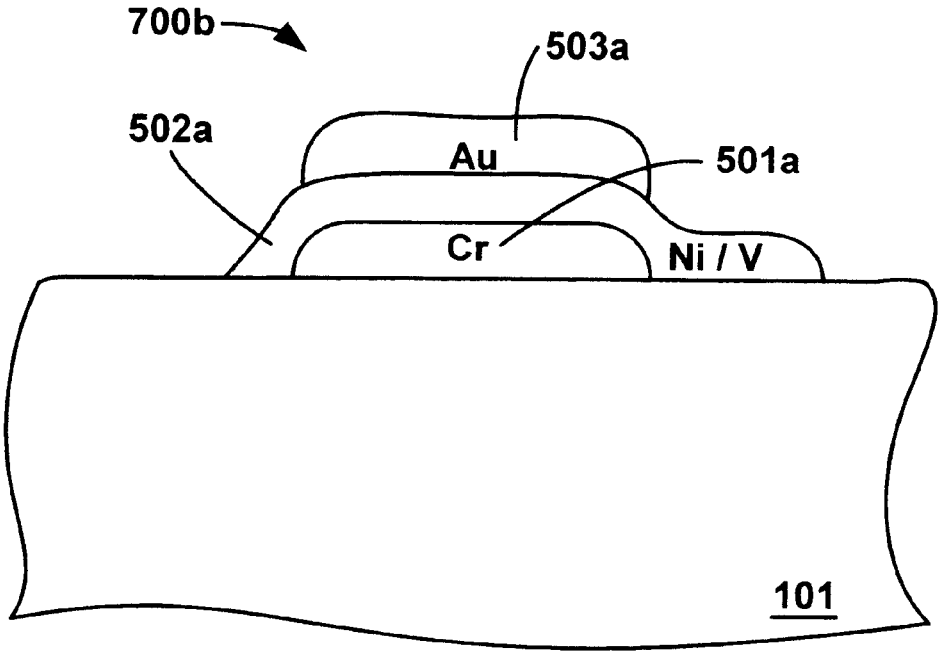
FIG. 7B is a diagram illustrating a three-layer electrode structure for a field emission display in accordance with the present claimed invention.

FIG. 7B shows an electrode 700*b* that is formed using a layer of gold that is deposited over the structure shown in FIG. 5B. The layer of gold is then masked and etched to form gold strip 503*a* that directly overlies nickel and vanadium alloy strip 502*a*'.

Figure 8A:
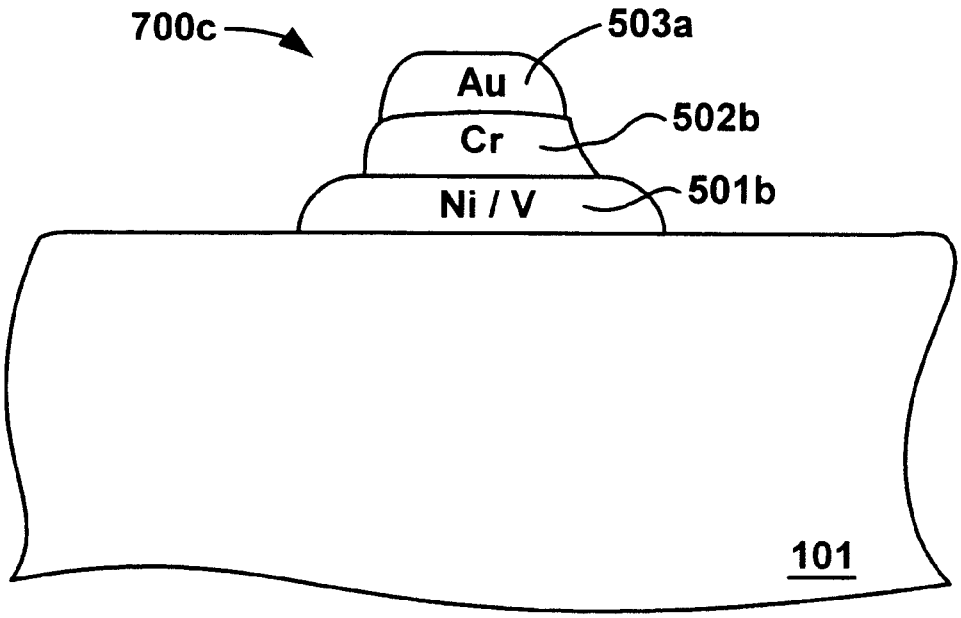
FIG. 8A is a diagram illustrating a three-layer electrode structure for a field emission display in accordance with the present claimed invention.

FIG. 8A shows an electrode 700*c* that is formed using a layer of gold that is deposited over the structure shown in FIG. 6A. The layer of gold is masked and etched to form gold strip 503*a*. It can be seen that gold strip 503*a* directly overlies chromium strip 502*b*.

Figure 8B:
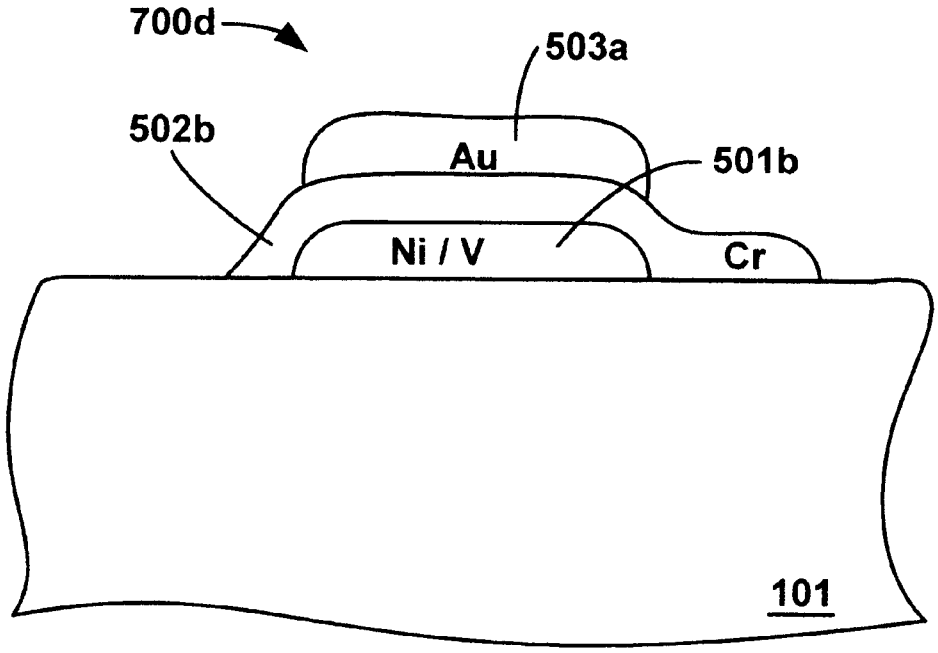
FIG. 8B is a diagram illustrating a three-layer electrode structure for a field emission display in accordance with the present claimed invention.

In the embodiment shown in FIG. 8B, electrode 700*d* is formed using a layer of gold that is deposited over the structure shown in FIG. 6B. The layer of gold is masked and etched to form gold strip 503*a*. It can be seen that gold strip 503*a* directly overlies chromium strip 502*b'*.

In one embodiment, strips 502*a*–503*a* extend across the entire length of all emitter electrodes. Alternatively, strips 502*a*–503*a* extend within those regions that will become the external contact pads for the display. This provides protection for the underlying strips 501*a*–501*b*. Thereby, strips 501*a*–501*b* are protected from various atmospheres and treatments after they are formed, such as plasma etch gasses, high temperature bakes, and aggressive liquid etchants, and these atmospheres are corrosive and/or oxidizing to various degrees, depending on process conditions.

In one embodiment, structures 503*a* are formed by sputter-deposition of gold. Alternatively, structures 503*a* are deposited using evaporative methods, electroplating, or electroless plating. In one embodiment of the present invention, structures 503*a* are formed using self-patterned metallization techniques; thereby eliminating the need for additional mask and etch steps in the formation of strips 503*a*.

In the embodiments shown in FIGS. 7A–8B, gold strip 503*a* directly overlies a portion of strip 502*a*, protecting strip 502*a* from subsequent thermal processing steps carried out in an oxidizing environment. This prevents any increase in contact resistance resulting from the process step carried out in the oxidizing environment as commonly occurs in prior art processes.

Figure 9:
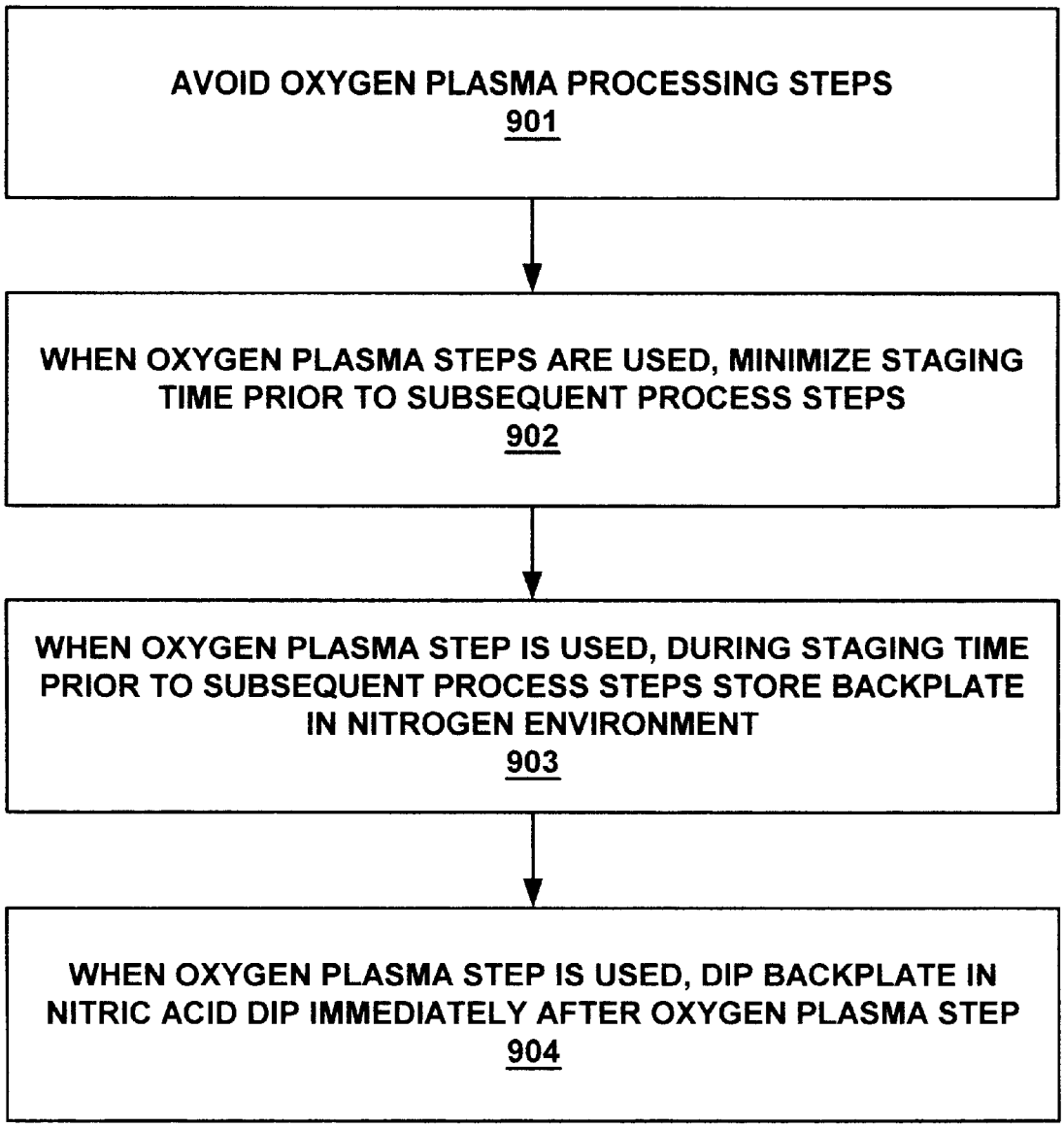
FIG. 9 is a diagram illustrating method for preventing oxidation of an electrode for a field emission display in accordance with the present claimed invention.

FIG. 9 shows various methods for avoidance of the deleterious effects of corrosive oxidation. As shown by step 901 of FIG. 9, the processes of the present invention avoid oxygen plasma processing steps. In the present embodiment, avoidance of oxygen plasma processing is accomplished by avoiding etch steps that use oxygen plasma.

Referring now to step 902, when oxygen plasma etch steps are used, staging time is minimized between the oxygen plasma processing step, and subsequent processing steps. Also, as shown by step 903, when oxygen plasma etch steps are used, during the staging time between the oxygen plasma processing step and subsequent processing steps, the backplate is stored in a nitrogen environment. In the present embodiment, the backplate is stored in a nitrogen-purged dessicator. In addition, as shown by step 904, a nitric acid dip is used immediately after the oxygen plasma step.

Referring to steps 901–904 of FIG. 9, the methods of steps 901–904 minimize the deleterious effects of corrosive oxidation on the device structures. More particularly, the methods of steps 901–904 prevent open gate lines, fragmented contact pads, high contact resistance, and poor adherence of subsequent layers (e.g., interlevel dielectric, gate metal, etc.) that result from corrosive oxidation of nickel thin films.

Figure 10:
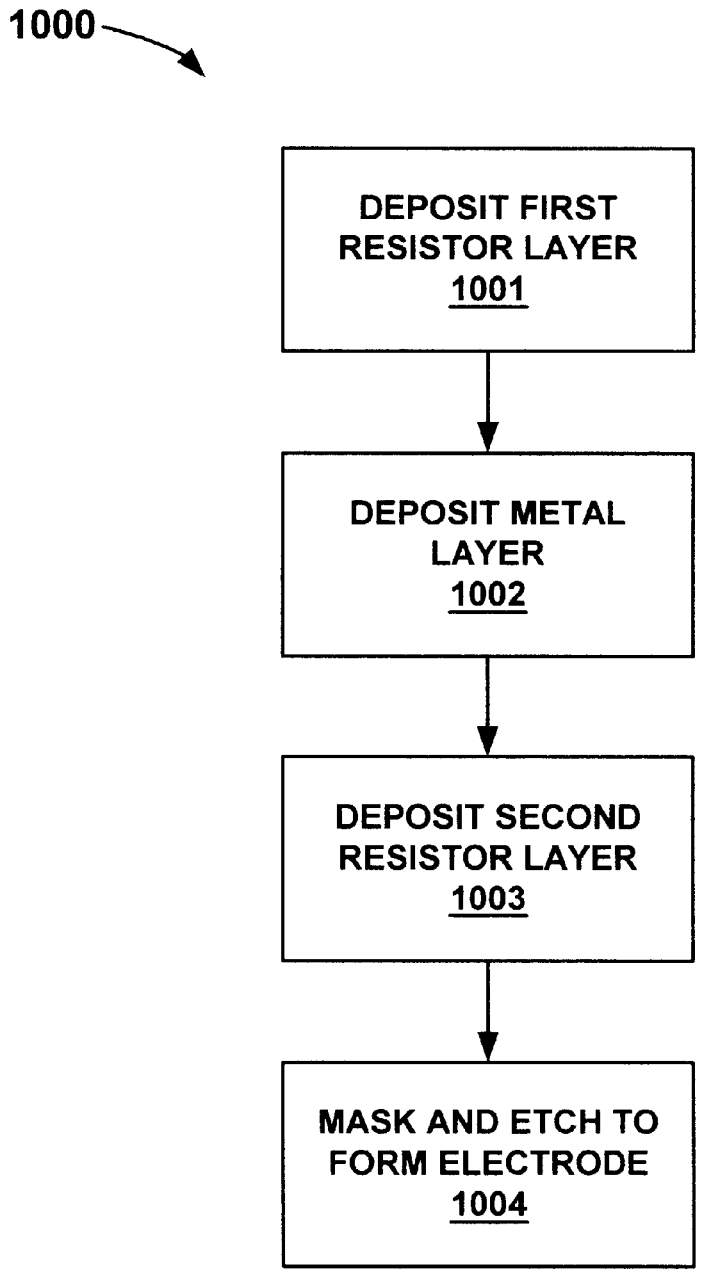
FIG. 10 is a diagram illustrating a method for forming an electrode structure for a field emission display in accordance with the present claimed invention.

FIG. 10 illustrates an embodiment of the present invention in which a thin resistor film is used to improve adhesion of subsequent layers. First, as shown by step 1001, a layer of resistor is deposited. Then, as shown by step 1002, a metal layer is deposited. A second layer of resistor is then deposited as shown by step 1003. The metal layer is masked and etched to form an electrode as shown by step 1004. In the present embodiment, mask and etch step 1004 is performed subsequent to step 1003. However, alternatively, mask and etch step 1004 is performed prior to step 1003. In the present embodiment, the resistor layer is oversized by 5 or more microns. In one embodiment, Cermet is used to form a resistive layer.

Figure 11A:
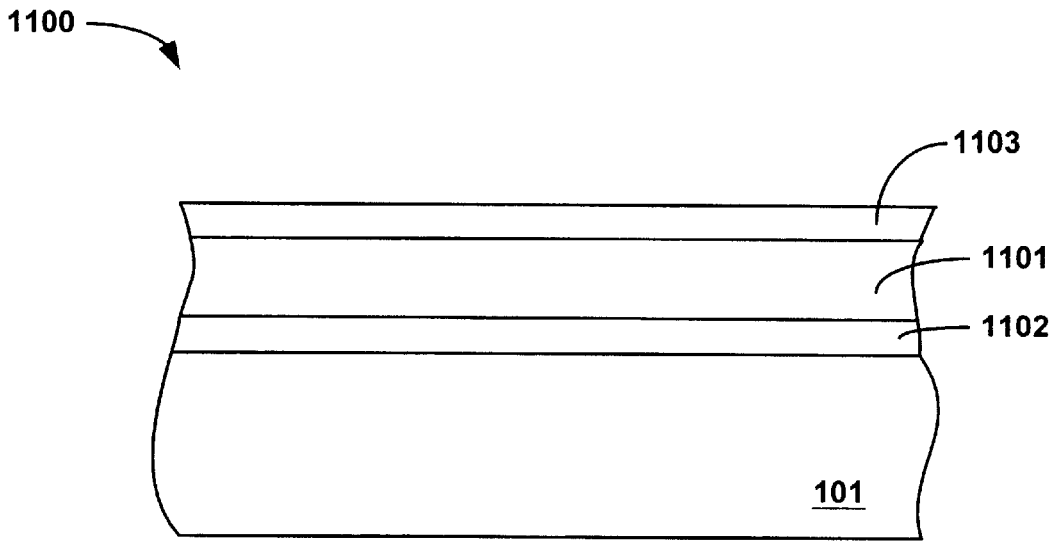
FIG. 11A is a diagram illustrating an electrode structure formed using the method of FIG. 10 in accordance with the present claimed invention.

FIG. 11A shows an exemplary structure 1100 formed according to the method 1000 shown in FIG. 10. Resistor layer 1102, formed according to step 1001 of FIG. 10, is shown to overlie substrate 101. A metal layer is then deposited (step 1002 of FIG. 10) and etched (step 1004 of FIG. 10) to form electrode 1101. Electrode 1101 is shown to directly overlie resistor layer 1102.

Continuing with FIG. 11A, resistor layer 1103, formed according to step 1104 of FIG. 10, directly overlies electrode 1101. It can be seen that electrode 101 is disposed between resistor layer 1102 and resistor layer 1103. Resistor layers 1102–1103 improve the adhesion of electrode 1101 to underlying and overlying structures. Also, resistor layers 1102–1103 protect electrode 1101 from corrosion and etching during subsequent process steps.

Figure 11B:
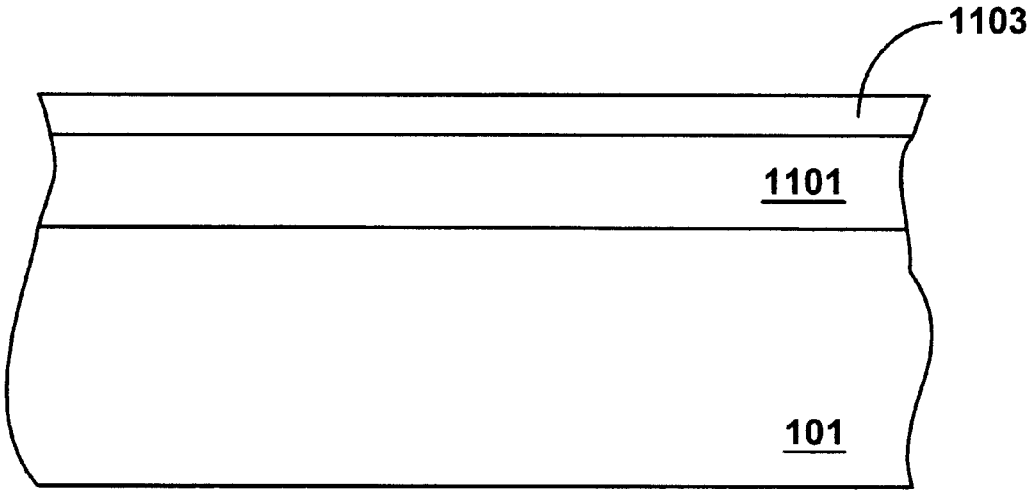
FIG. 11B is a diagram illustrating an electrode structure having a single resistor layer in accordance with the present claimed invention.

In an alternate embodiment, a single resistor layer is used. In this embodiment, step 1001 of FIG. 10 is not performed, resulting in the structure shown in FIG. 11B. Referring now to FIG. 11B, a metal layer is deposited (step 1002) and etched (step 1004) to form electrode 1101. Resistor layer 1103, formed according to step 1104 of FIG. 10, directly overlies electrode 1101. It can be seen that resistor layer 1103 directly overlies electrode 1101. Resistor layer 1103 improves the adhesion of overlying structures to electrode 1101, protects electrode 1101 from corrosion and etching during subsequent process steps.

Figure 12:
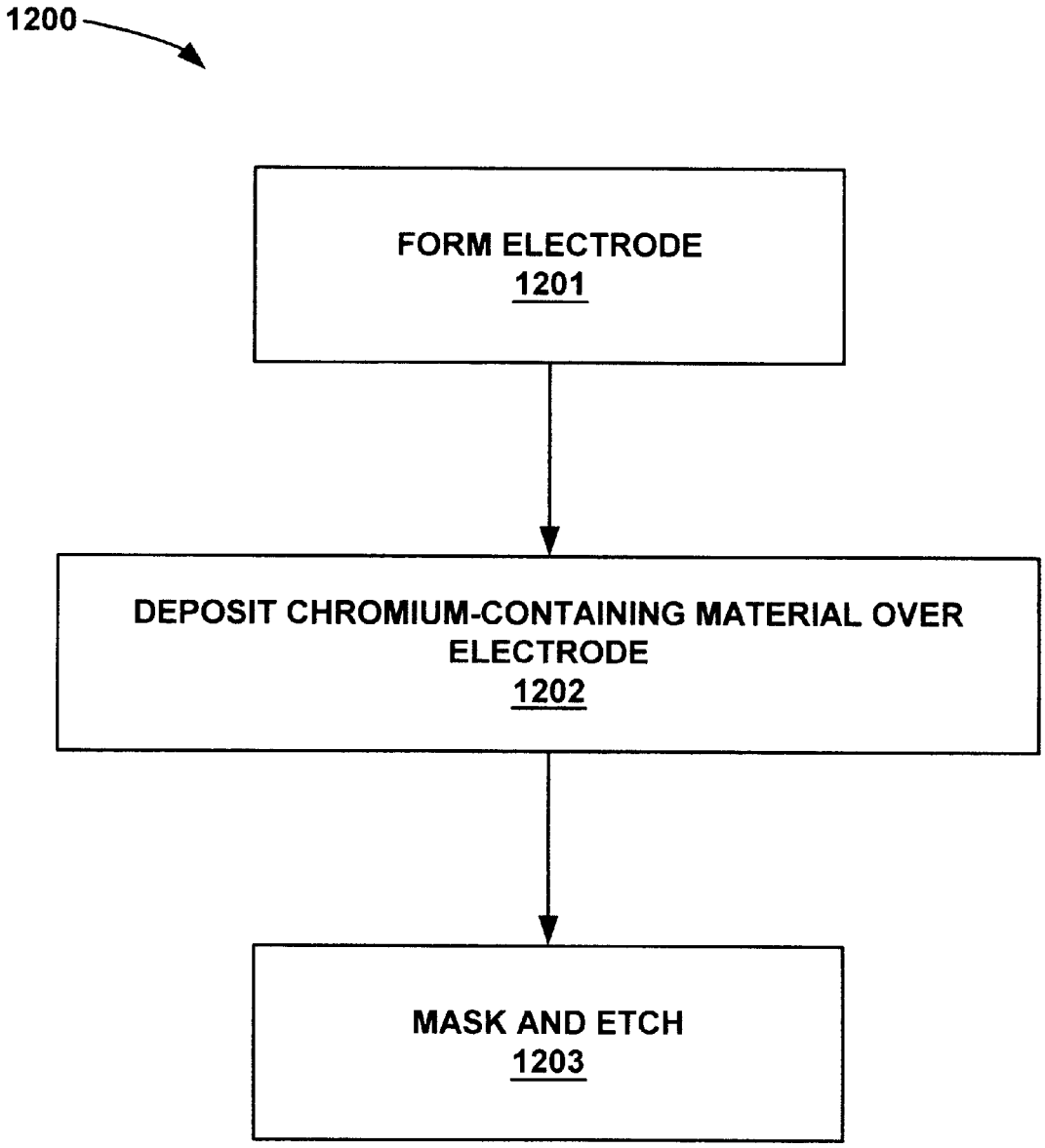
FIG. 12 is a diagram illustrating a method for forming an electrode structure for a field emission display in accordance with the present claimed invention.

Referring now to FIG. 12, an embodiment of the present invention is shown in which a chromium-containing film is disposed over an electrode. Referring to step 1201, an electrode is formed. In the present embodiment, an electrode is formed by deposition, mask and etch of a layer of nickel and vanadium alloy. A chromium-containing material is then deposited as shown by step 1202. In the present embodiment, the chromium-containing material is a compound containing chromium and silicon dioxide ($SiO_2$). However, alternatively, other chromium-containing materials can also be used.

Continuing with FIG. 12, in an alternate embodiment, the chromium-containing material is a metal sandwich containing chromium at one or more levels. In this embodiment, heat is used to provide interdiffusion between the chromium and the other material used to produce the metal sandwich structure. In one embodiment, SiC is used in the sandwich structure.

Referring still to FIG. 12, mask and etch steps are performed as shown by step 1203. In the present embodiment, mask and etch step 1203 removes excess chromium-containing material not required for protecting the electrode structure formed in step 1201. In the present embodiment, mask and etch step 1203 leaves chromium-containing material covering the top and sides of the electrode structure formed in step 1201.

Figure 13:
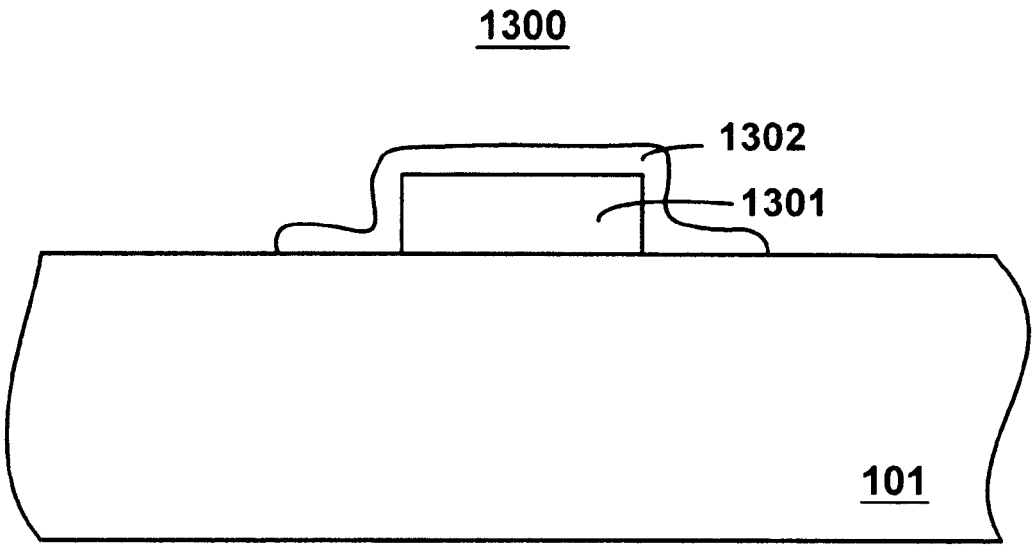
FIG. 13 is a diagram illustrating an electrode structure formed using the method of FIG. 12 in accordance with the present claimed invention.

FIG. 13 shows an exemplary structure 1300 formed according to method 1200 of FIG. 12. Electrode 1301, formed according to step 1201 of FIG. 12, is shown to overlie substrate 101. In the present embodiment, electrode 1301 is formed of nickel and vanadium alloy. However, alternatively, any of a number of other materials can be used to form electrode 1301. Strip of Chromium-containing material 1302 is formed according to step 1202–1203 of FIG. 12. It can be seen that strip of chromium-containing material 1302 directly overlies electrode 1301.

Figure 14:
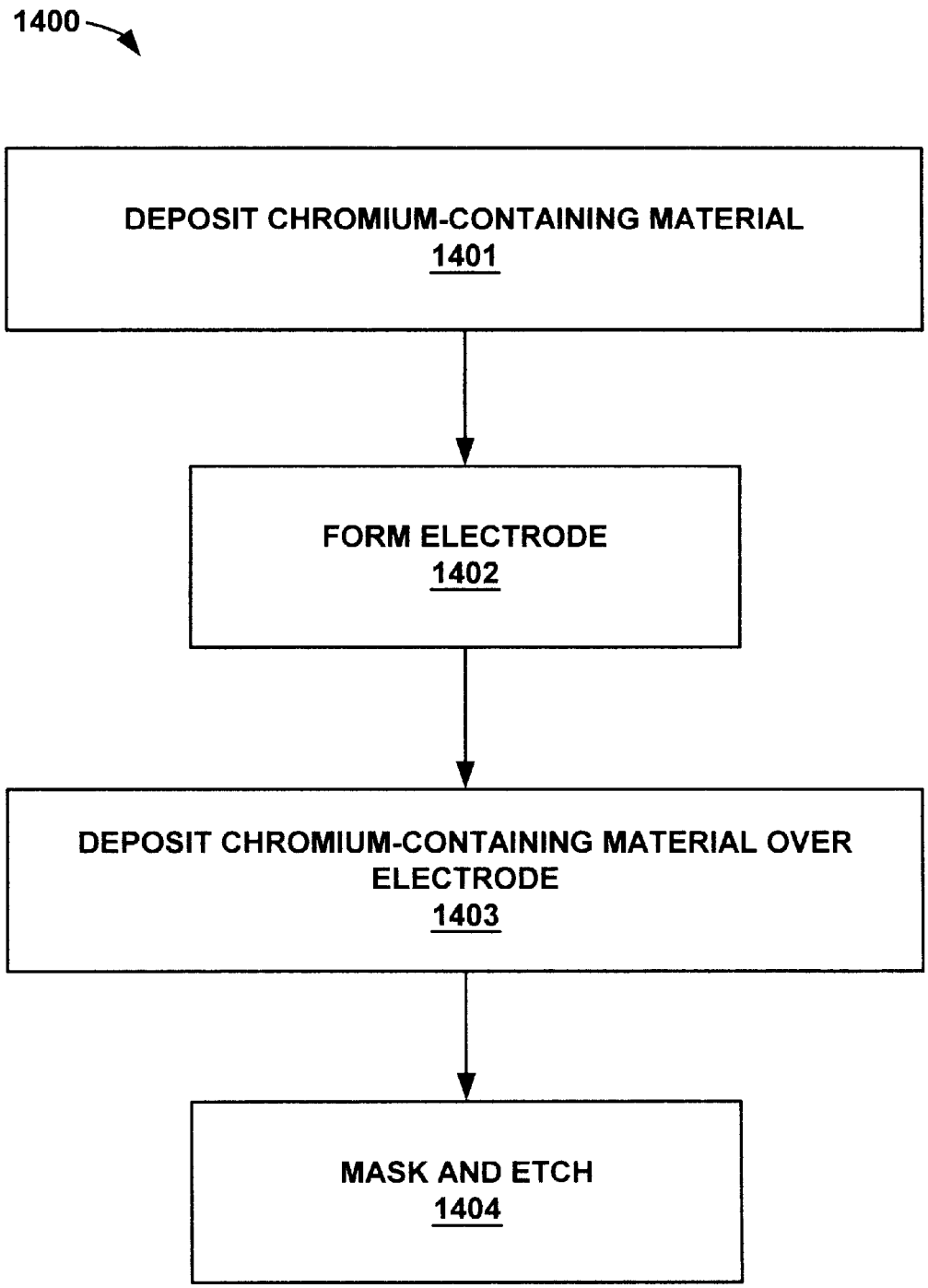
FIG. 14 is a diagram illustrating a method for forming an electrode structure for a field emission display in accordance with the present claimed invention.
Figure 15:
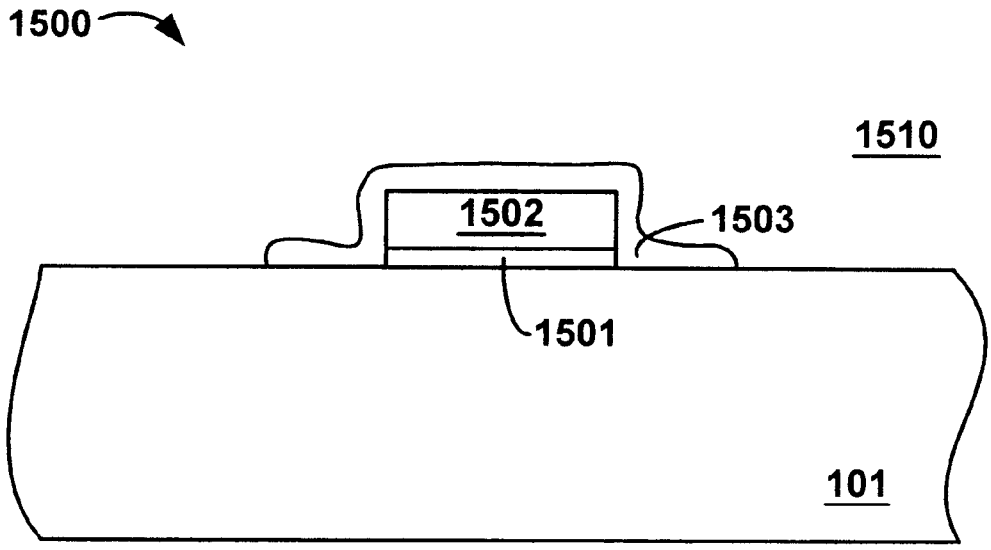
FIG. 15 is a diagram illustrating an electrode structure formed using the method of FIG. 14 in accordance with the present claimed invention.

FIGS. 14–15 illustrate an embodiment that includes two layers of chromium-containing material. Referring now to step 1401 of FIG. 14, a first layer of chromium-containing material is deposited. Next, as shown by step 1402, an electrode is formed. In the present embodiment, an electrode is formed by deposition, mask and etch of a layer of nickel and vanadium alloy. A second layer of chromium-containing material is then deposited as shown by step 1403. In one embodiment, the chromium-containing material is a layer of chromium and silicon dioxide material. In another embodiment, metallic chromium is used.

Referring still to FIG. 14, mask and etch steps are performed as shown by step 1404. In the present embodiment, mask and etch step 1404 removes excess chromium-containing material not required for protecting the electrode formed in step 1402. In the present embodiment, mask and etch step 1404 leaves that portion of the chromium-containing material deposited in step 1403 which covers the top and sides of the electrode structure formed in step 1201.

FIG. 15 shows an exemplary electrode structure 1500 formed according to method 1400 of FIG. 14. Strip of chromium-containing material 1501 (step 1402 of FIG. 14) is shown to be formed over substrate 101. Electrode 1502 (step 1402 of FIG. 14) directly overlies strip of chromium-containing material 1501. In the present embodiment, electrode 1502 is formed of nickel and vanadium alloy. However, alternatively, any of a number of other materials can be used to form electrode 1502. In the present embodiment, the mask and etch steps used to form electrode 1502 also etch the layer of chromium-containing material deposited in step 1401 so as to simultaneously form strip 1501 and electrode 1502.

As shown by steps 1403–1404 of FIG. 14, a layer of chromium-containing material is deposited, masked and etched, forming strip of chromium-containing material 1503. It can be seen that strip 1503 directly overlies electrode 1502, covering the top and sides of electrode 1502.

Though the electrode structures of FIGS. 5A–8B and 10–15 are illustrated as being applied to emitter electrodes, it is appreciated that these electrode structures can also be used for gate electrodes.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. An electrode structure for a field emission display, said electrode structure comprising:

a first layer comprising chromium; and a second layer disposed immediately over said first layer, said second layer comprising a nickel and vanadium alloy.

2. The electrode structure for a field emission display of claim 1 wherein said second layer is disposed over said first layer so as to cover the top surface and the side surfaces of said first layer.

3. The electrode structure for a field emission display of claim 1 further comprising a third layer, said third layer disposed immediately over said second layer, said third layer comprising gold.

4. An electrode structure for a field emission display, said electrode structure comprising:

a first layer comprising a nickel and vanadium alloy; and a second layer disposed immediately over said first layer, said second layer comprising chromium.

5. The electrode structure for a field emission display of claim 4 wherein said second layer is disposed over said first layer so as to cover at least some of the top surface and the side surfaces of said first layer.

6. The electrode structure for a field emission display of claim 4 further comprising a third layer, said third layer disposed immediately over said second layer, said third layer comprising gold.

7. A field emission display including a faceplate having an active area surface and a cathodic structure formed on a backplate, said cathodic structure comprising:

an electrode disposed over said backplate said electrode having a top surface and side surfaces;

a first layer of chromium-containing material disposed over said electrode such that said first layer of chromium-containing material directly overlies said top surface of said electrode and such that said first layer of chromium-containing material is disposed over said side surfaces of said electrode;

a resistive layer formed over said first layer of chromium-containing material and electrically coupled to said electrode; and a plurality of emitters electrically coupled to said resistive layer such that, upon the application of power to said electrode, electrical current selectively flows through said resistive layer and selectively engages said emitters to generate electrons for striking said active area of said faceplate to generate a visible display.

8. The field emission display of claim 7 wherein said first layer of chromium-containing material further comprises chromium and silicon dioxide.

9. The field emission display of claim 7 wherein said first layer of chromium-containing material further comprises metallic chromium.

10. The field emission display of claim 7 further comprising a second layer of chromium-containing material, said second layer of chromium-containing material disposed under said electrode.

* * * * *